US007344214B2

(12) United States Patent
Chan

(10) Patent No.: US 7,344,214 B2
(45) Date of Patent: Mar. 18, 2008

(54) INTELLIGENT INK CARTRIDGE AND METHOD FOR MANUFACTURING THE SAME

(75) Inventor: On Bon Peter Chan, Hong Kong (CN)

(73) Assignee: Print-Rite Unicorn Image Products Co., Ltd. of ZhuHai, ZhuHai (CN)

( * ) Notice: Subject to any disclaimer, the term of this patent is extended or adjusted under 35 U.S.C. 154(b) by 351 days.

(21) Appl. No.: 10/505,381

(22) PCT Filed: Apr. 28, 2002

(86) PCT No.: PCT/CN02/00302

§ 371 (c)(1),
(2), (4) Date: Aug. 20, 2004

(87) PCT Pub. No.: WO03/070472

PCT Pub. Date: Aug. 28, 2003

(65) Prior Publication Data

US 2005/0088495 A1 Apr. 28, 2005

(30) Foreign Application Priority Data

Feb. 22, 2002 (CN) ..... 02 1 00694

(51) Int. Cl.
*B41J 2/195* (2006.01)
*B41J 2/175* (2006.01)

(52) U.S. Cl. ..... 347/7; 347/86

(58) Field of Classification Search ..... 347/7
See application file for complete search history.

(56) References Cited

U.S. PATENT DOCUMENTS

| | | | | |
|---|---|---|---|---|
| 5,504,669 | A * | 4/1996 | Wakabayashi et al. | 700/2 |
| 5,610,635 | A | 3/1997 | Murray et al. | |
| 5,633,573 | A * | 5/1997 | van Phuoc et al. | 320/128 |
| 6,155,664 | A * | 12/2000 | Cook | 347/7 |
| 6,473,571 | B1 * | 10/2002 | Wegman et al. | 399/12 |

FOREIGN PATENT DOCUMENTS

| | | |
|---|---|---|
| EP | 1 004 448 | 5/2000 |
| EP | 1 066 967 | 1/2001 |
| EP | 1 080 912 | 3/2001 |
| EP | 1 136 268 | 9/2001 |
| WO | WO 01/26034 | 4/2001 |

OTHER PUBLICATIONS

Toshiba's Microcomputer Product Guide; pp. 53-55.*
International Search Report corresponding to International Application No. PCT/CN02/00302.

* cited by examiner

*Primary Examiner*—Matthew Luu
*Assistant Examiner*—Shelby Fidler
(74) *Attorney, Agent, or Firm*—Fay Sharpe LLP

(57) ABSTRACT

This relates to an intelligent ink cartridge and method for manufacturing the same. The ink cartridge comprises at least one ink chamber for containing ink, an electronics module for storing identification information of the ink cartridge and ink remaining data. The electronics module comprises a micro-controller with embedded non-volatile memory, for storage, controlling, calculation and accessing of ink remaining data, so that the maximum ink capacity of the ink cartridge for use with the printer can be improved.

27 Claims, 9 Drawing Sheets

--Prior Art--

--Prior Art--

--Prior Art--

--Prior Art--

INTELLIGENT INK CARTRIDGE AND METHOD FOR MANUFACTURING THE SAME

FIELD OF THE INVENTION

The present invention relates to an ink cartridge for use with an ink jet printer or a plotter and method for manufacturing the same. In particularly, it relates to an intelligent ink cartridge that can provide a user ink amount data of the ink cartridge, and method for manufacturing the same.

BACKGROUND OF THE INVENTION

In the ink jet apparatuses using intelligent ink cartridges, in recent years, passive memory, usually in the form of serial EEPROM, has being used as electronics modules in ink cartridges, for example, EPSON printer cartridges. Such passive memory stores fixed data such as manufacturer name, manufacturing date, type of ink, capacity, cartridge model number, etc, as well as rewritable operational data such as date of first installation, ink volume remaining in the cartridge, etc.

Data stored in electronics module of a particular intelligent ink cartridge can be read by printer on demand. Updated data concerning ink volume remaining are usually being written back to the electronics module during printer power off or removal of ink cartridge from printer. Usually, the printer controls the ink volume updating while the passive memory in intelligent ink cartridge just stores faithfully the updated data issued from the printer.

For example, Chinese patent application, pub. No. CN1257007A, has disclosed an intelligent ink cartridge, using a 8-bit EEPROM to store data concerning ink remaining of ink cartridge. It is by the printer or by IC and storage member on the ink cartridge carrier of the printer that data of EEPROM is accessed. For ink cartridge using passive memory as electronics module, the hardware architecture can be classified mainly into independent interfacing for each cartridge and multi-drop common bus in which more than one cartridge are connected to the bus between electronics modules of ink cartridges and the printer, as shown respectively in FIG. 1 to FIG. 4. It should be noted that the hardware architecture as shown in FIG. 1 can be replicated for different color ink cartridges. As for FIG. 2, there may exist more than 2 cartridges connecting to the common bus.

As shown in FIGS. 1 to 4, data transfer between printer and ink cartridges is initiated and controlled by the printer. Data is read from cartridges during power on of printer or installation of cartridge to the printer. Data is written to ink cartridges during power off of printer, or moving cartridge holder to unload position, or marking the first use of a new cartridge after read operation. For individually controlled hardware architecture, data transfer between printer and each individual cartridge takes place simultaneously. For multi-drop common bus architecture, printer addresses (address embedded with read/write command) each cartridge for data transfer in sequence.

Data strings read from ink cartridges are normally longer than data being written to ink cartridges. This is due to the fact that data written to cartridges are just variables related to ink volume, date installed, etc, while data read contain fixed information such as cartridge code and type, capacity, manufacturer and manufacturing date, etc.

Typical communication protocol for exchange of data between printer and ink cartridges for individually controlled architecture is shown in FIG. 3. For read cycle (R/W=0), data flow direction is from ink cartridge to printer. For write cycle (R/W=1), data flow direction is from printer to ink cartridge.

Typical communication protocol for exchange of data between printer and an ink cartridge for multi-drop common bus architecture is shown in FIG. 4.

As an example, a common code may be used in which 3 bits are serving as the address for addressing up to 8 cartridges and 1 bit is used to signify read or write operations. Read operation after write cycle can be added to ensure data written to cartridges correctly stored.

Usually ink capacity of the ink cartridge is being basically constant, and it is little, so the user has to change frequently the ink cartridge after it runs out. This frequent change of ink cartridges not only spends much time, but waste the resources such as ink. As data updating of electronics module in ink cartridges is controlled by the printer, the manufacturers of ink cartridges have to design electronics module compatible with the printer. That is, it is very difficult for the remanufacturers to come up with a much higher ink volume cartridge. And actually, there are much ink remained in the ink cartridge when the printer alerts the user with the ink out condition. Thus, inks are not used fully in the cartridge and then a user replaces it for a new one, as a result, much ink is thrown away.

Accordingly, an improved ink cartridge with higher ink capacity and compatible with different inks that address these problems and others would be desirable.

SUMMARY OF THE INVENTION

According to one aspect of the present invention there is provided an intelligent ink cartridge with an electronics module, which can access, and in addition, control the EEPROM built in, and as a result, design out an ink cartridge with higher ink capacity.

According to another aspect of the present invention there is provided an electronics module which controls accessing and processing operations of ink remaining data, as a result, to improve ink capacity of the ink cartridge for use with the printer, and improve the volumetric efficiency of ink.

The present invention provides an intelligent ink cartridge, comprising at least one ink chamber storing ink, an electronics module storing identification information of ink cartridge and ink remaining data. The electronics module is a micro-controller with a non-volatile memory for controlling calculation and access of ink remaining data in the ink cartridge to improve the maximum ink volume of the ink cartridge for use with the printer.

According to the intelligent ink cartridge, the non-volatile memory is an EEPROM that is serially accessed.

According to the intelligent ink cartridge, the micro-controller is a RISC 8-bit micro-controller of CMOS, comprising: an ALU(arithmetic and logic unit) connected to a 8-bit data bus, an EEPROM memory storing identification information of ink cartridge and ink remaining data, plural registers, interrupt unit, serial periphery interface unit, timer, analog comparator, I/O interface, and a fast flash connected to the ALU by the register, storing a program controlling reading and writing operations and calculation of ink remaining data.

The intelligent ink cartridge further comprises a R-C control circuit with appropriate time constant, used to distinguish the checking read cycle and the normal read cycle, and the R-C control circuit is connected to the input interface of the micro-controller.

The present invention also provides a method of manufacturing an intelligent ink cartridge, which comprises at least one ink chamber for storing ink, an electronics module storing identification information of ink cartridge and ink remaining data.

According to the method, the electronics module is made according to the following steps:

- to set a special-purpose micro-controller in the ink cartridge;
- to write identification information of ink cartridge and the program controlling access and process operations of ink remaining data into the non-volatile memory of the special-purpose micro-controller; and
- to carry out the program so that it can meet the requirement of an ink jet apparatus's controlling and reading/writing ink remaining data when ink capacity of ink cartridge is increased.

According to the method of manufacturing the intelligent ink cartridge, identification information of ink cartridge and ink remaining data is stored into an EEPROM memory in the special-purpose micro-controller, and the program controlling access and process operations of ink remaining data is stored into a fast flash in the micro-controller. (Process operations can also be stored in any other micro-controllers having equal or higher computational ability and storage capacities).

According to a further aspect of the present invention there is provided a special-purpose electronics module of an intelligent ink cartridge, which is used to store identification information of the ink cartridge and ink remaining data, and the electronics module is a micro-controller with embedded non-volatile memory and the micro-controller is used to control calculation and access of ink remaining data in the ink cartridge to improve the maximum ink volume of the ink cartridge for use with the printer.

According to the electronics module of the intelligent ink cartridge, the non-volatile memory in the micro-controller stores identification information and the program controlling access and process operations of ink remaining data. By carrying out the program it can meet the requirement of an ink jet apparatus's controlling and reading/writing ink remaining data when ink capacity of ink cartridge is increased.

BRIEF DESCRIPTION OF THE DRAWINGS

The beneficial effect will be more apparent by reference to following detailed specification of preferred embodiments combined with the drawings, in which.

DETAILED DESCRIPTION OF THE INVENTION

As shown in FIGS. 1 to 4, an intelligent ink cartridge has been disclosed, but only an EEPROM is set on the cartridge and accessing ink remaining data is controlled by IC in ink jet printer.

An intelligent ink cartridge brought by the present invention replaces the passive serial EEPROM with a micro-controller with an embedded EEPROM as electronics module to improve the maximum of ink volume of the ink cartridge, as shown in FIGS. 5 to 9.

Figure 1:
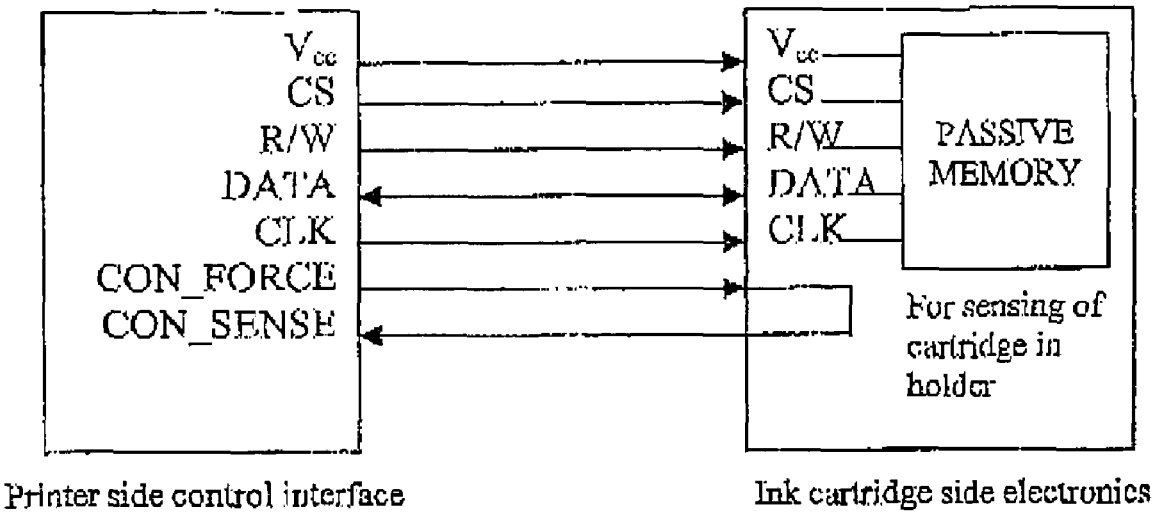
FIG. 1 is a view showing the interface for ink cartridges with individual control architecture.
Figure 2:
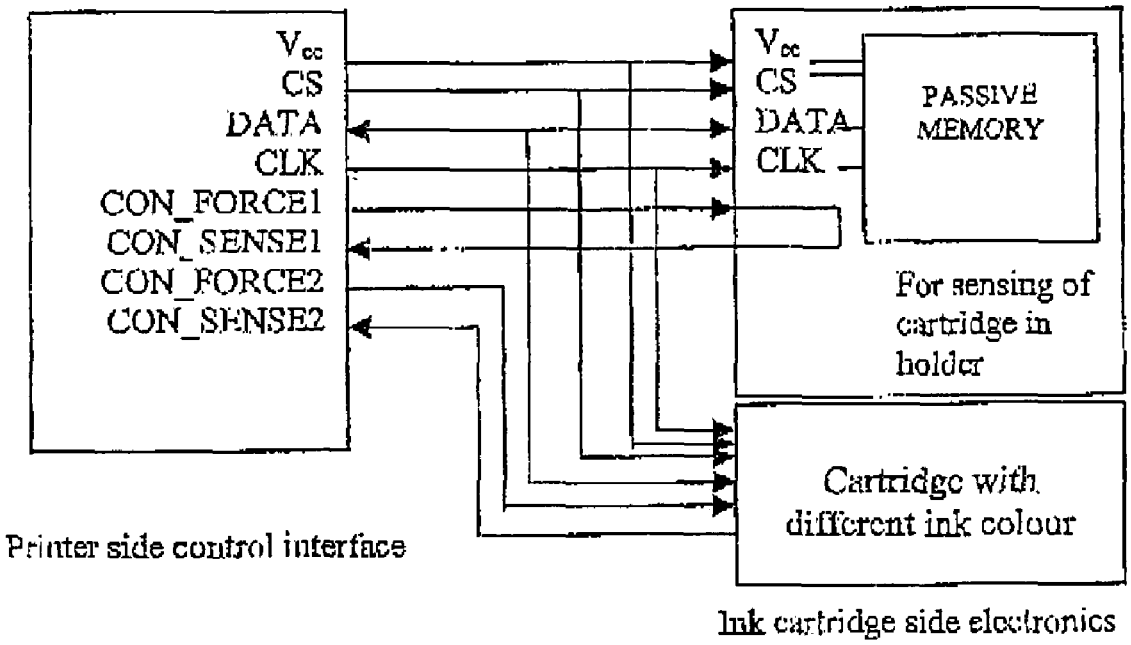
FIG. 2 is a view showing the interface for ink cartridges with multi-drop common bus architecture.
Figure 3:
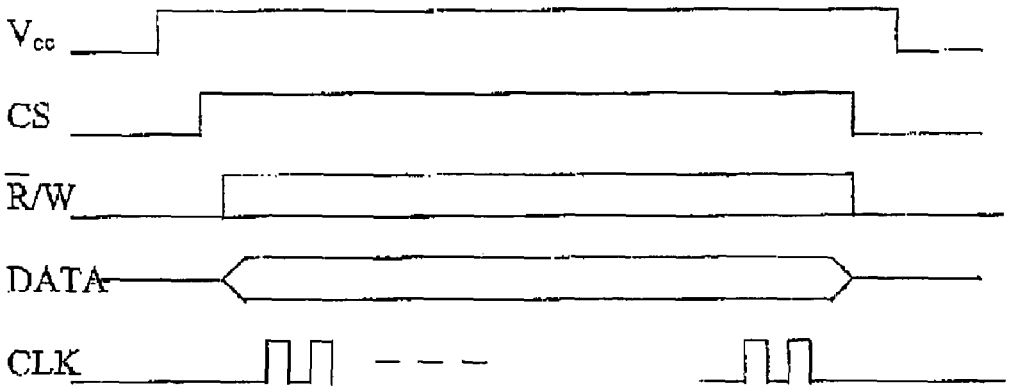
FIG. 3 shows data exchange protocol for individually controlled architecture in FIG. 1.
Figure 4:
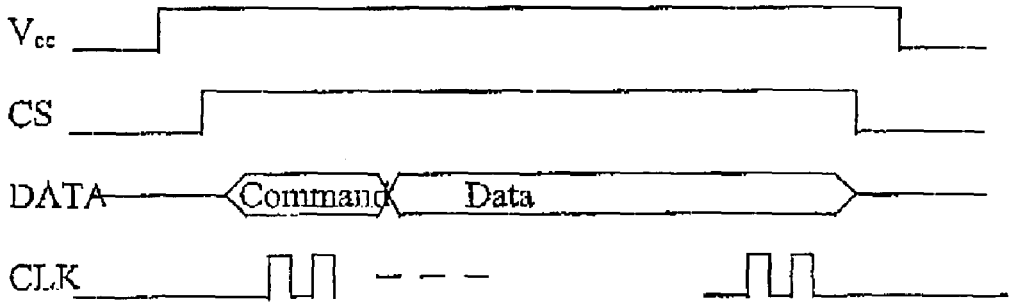
FIG. 4 shows data exchange protocol for multi-drop common bus architecture in FIG. 2.
Figure 5:
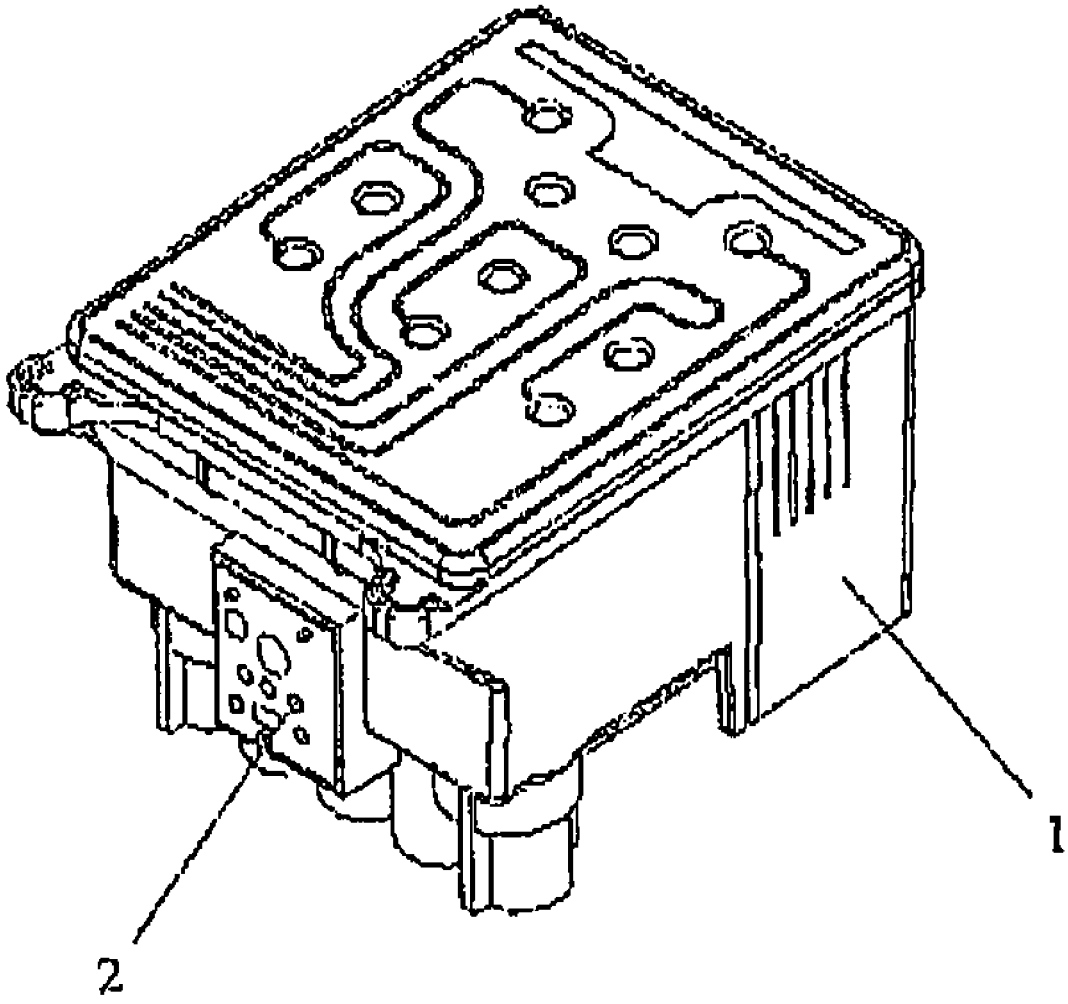
FIG. 5 is a perspective view showing an intelligent ink cartridge of the present invention.
Figure 6:
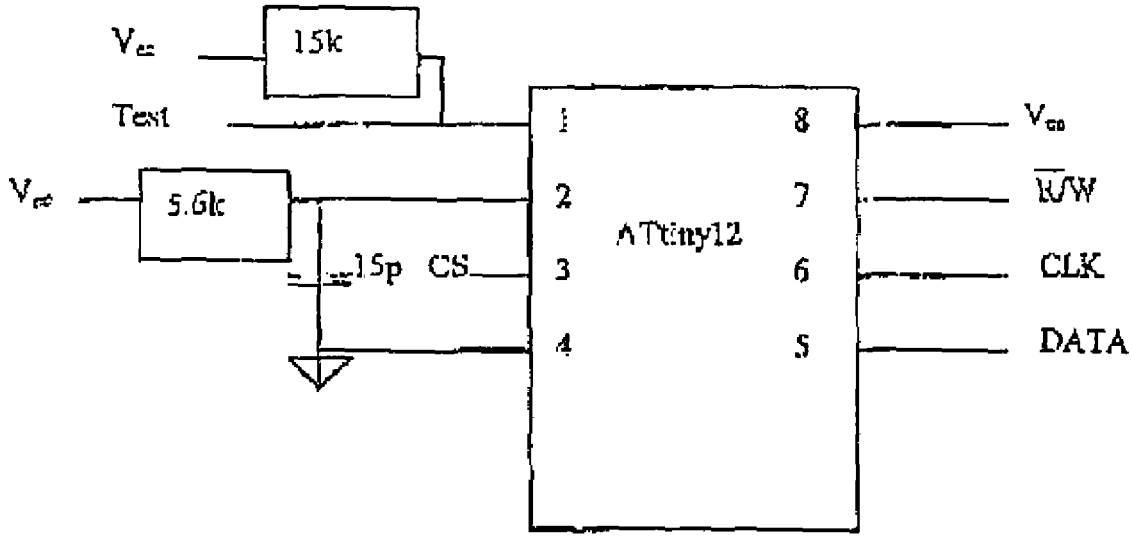
FIG. 6 is a circuit diagram for individually controlled architecture.
Figure 7:
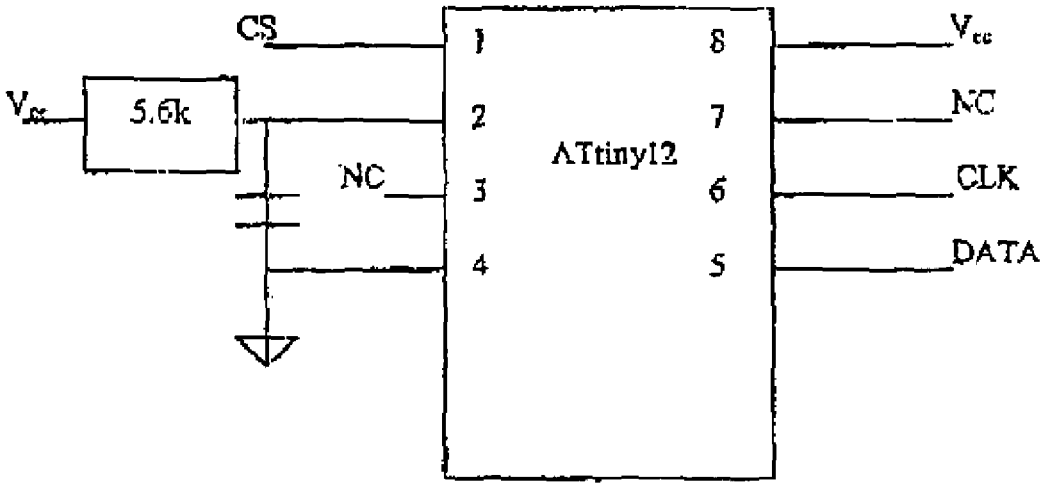
FIG. 7 is a circuit diagram for multi-drop common bus architecture.

As shown in FIG. 5, the intelligent ink cartridge of the present invention consists of ink chamber 1 and electronics module 2. Electronics module 2 is a micro-controller with an embedded EEPROM. As for data exchange between the ink cartridge with individual control architecture and the printer, the protocol of data communication between electronics module 2 in the intelligent ink cartridge and the printer is the same as the prior art, as illustrated in FIG. 6. And as shown in FIG. 7, as for data exchange between the ink cartridge with multi-drop common bus architecture and the printer, the protocol of data communication between electronics module 2 in the intelligent ink cartridge and the printer is also the same as the prior art.

Figure 8:
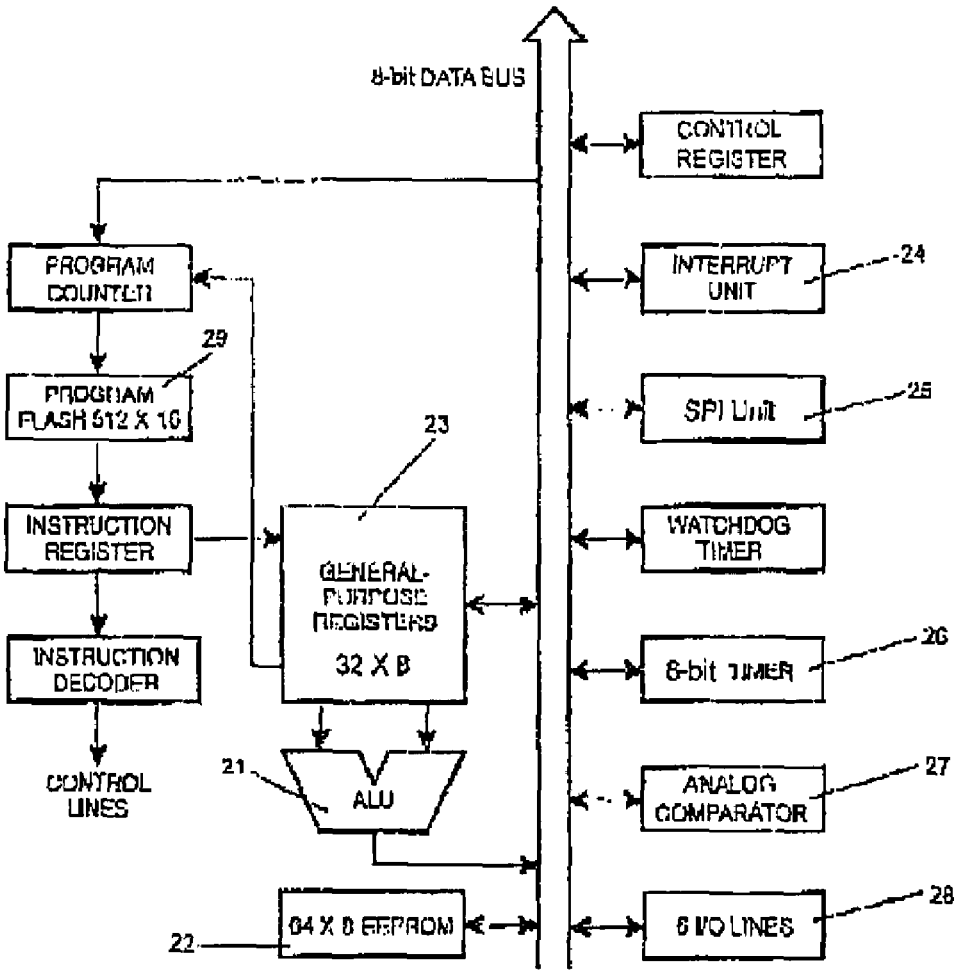
FIG. 8 is a block diagram of micro-controller in the intelligent ink cartridge in FIG. 5.

As shown in. FIG. 8, the electronics module 2 in the intelligent ink cartridge provided by the present invention is a general-purpose micro-controller, comprising the hardware structure and the control software embedded therein. The hardware comprises a RISC 8-bit micro-controller of CMOS, which comprises ALU 21 connected by 8-bit data bus, EEPROM memory 22 storing identification information of ink cartridge, 32×18 general-purpose register 23, interrupt unit 24, serial periphery interface unit 25, 8-bit timer 26, analog comparator 27, six I/O lines 28, and a fast flash 29 connected to the general-purpose register 23, which is being connected to ALU 21. And the software portion comprises a program controlling calculation and reading/writing operations of ink remaining data and which is embedded in the fast flash 29. There are several embodiments as follows based on the control method of the software. The implementation of the present invention can be done in several different ways, depending on the hardware structure as well as the protocol between ink cartridges and printers.

Assuming that the variable related to ink volume is the ink being utilized in percentage (i.e. 0% for new cartridge and 100% for empty cartridge), then the printer will update the ink volume every time the printer is powered off or when the cartridge is moved to cartridge installation position.

Figure 10:
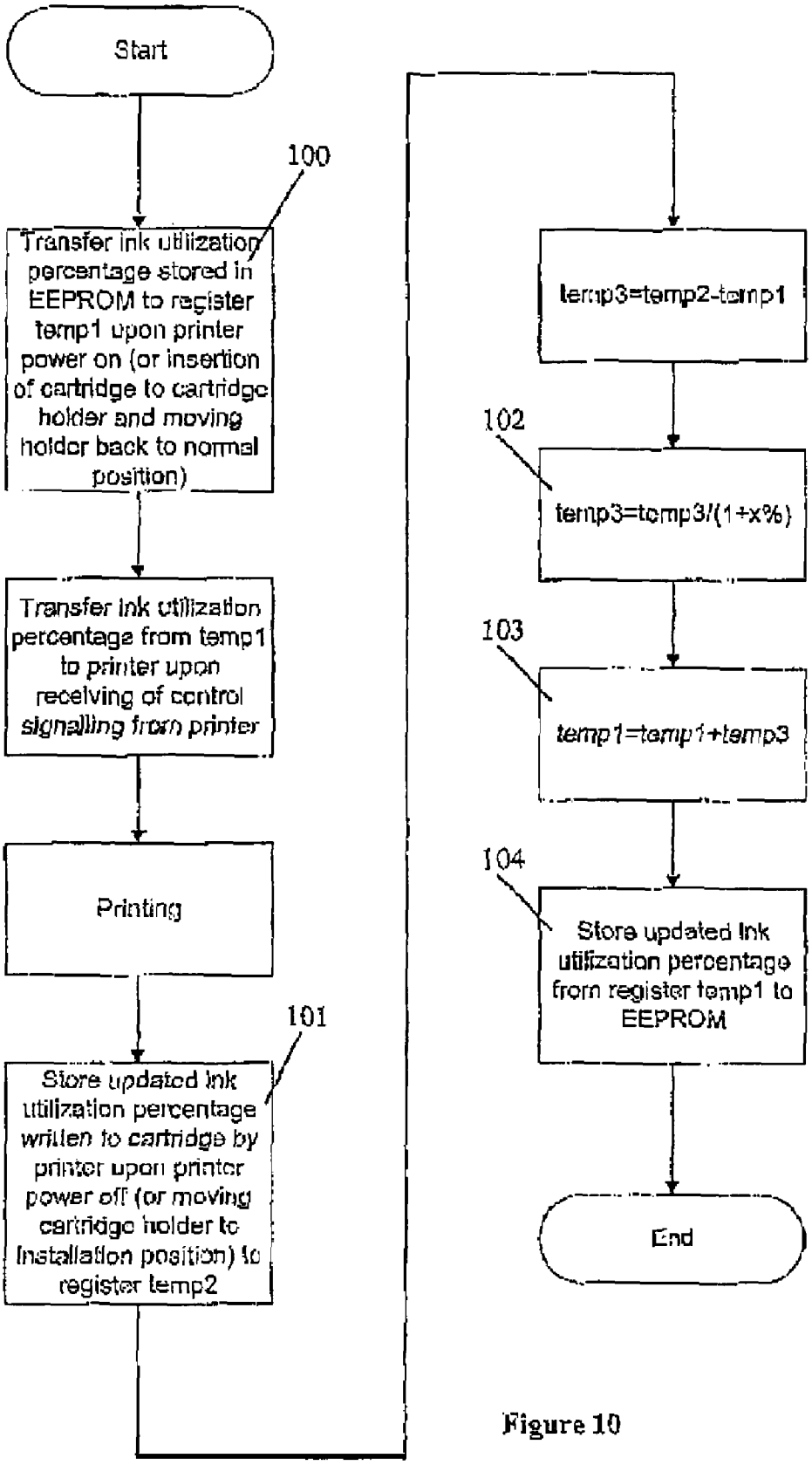
FIG. 10 is a flowchart for the first embodiment of the invention.

In the first embodiment of the invention the flowchart is shown in FIG. 10. To increase the capacity by approximately x %, the simplest approach is:

to carry out the instructions as follows, as shown at step 100:

to transfer ink utilization percentage stored in EEPROM register temp1 in the micro-controller during printer power on or when the ink cartridge is installed on the ink jet apparatus and moved to normal position;

to transfer the ink utilization percentage into the ink jet apparatus from register temp1 when control signal of the inkjet apparatus is received;

to update the ink utilization percentage after printing;

to store the ink utilization percentage written into the ink cartridge from the ink jet apparatus into register temp2 in the micro-controller during printer power off or when the ink cartridge is moved to installation position.

to subtract the previously stored ink utilization percentage temp1 from updated ink utilization percentage temp2 written to the cartridge from the printer during power off, and store the result into temp3, as shown at step 101;

to divide the value temp3=temp2−temp1 obtained in step 101 by (1+x %), as shown at step 102;

to add the value temp3 obtained in step 102 to previously stored ink utilization percentage temp1, that is, temp1=temp3+temp1, as shown at step 103;

to store the value obtained from step 103 to EEPROM as shown at step 104; and to use the value temp1 stored in step 104 as the output from cartridge for the next printer power on read cycle, as shown at step 101.

However, should the printer checks the value read from ink cartridge against that being written to ink cartridge from the previous power off during power on and initiates a head cleaning operation if these values not identical, a certain ink utilization percentage will be deducted for the head cleaning operating. If that percentage exceeds the increment obtained from the scaling computation as discussed above, this design approach cannot be applied.

Figure 11:
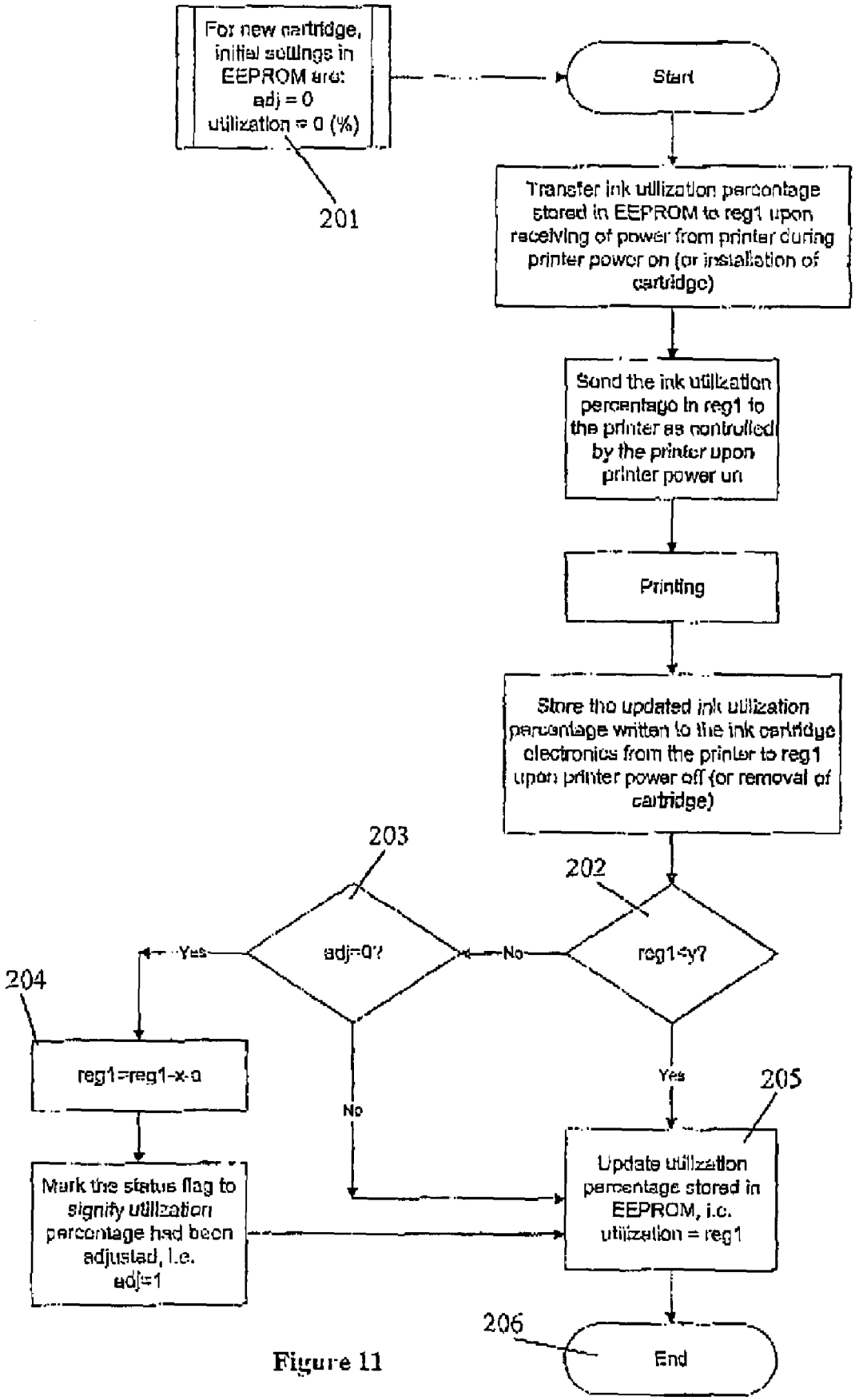
FIG. 11 is a flowchart for the second embodiment of the invention.

To overcome the limitation of embodiment 1, the following approach in the second embodiment is devised: (as shown in FIG. 11).

to use a software flag (adj) stored in EEPROM in the ink cartridge electronics to signify whether the ink utilization percentage had been adjusted by the micro-controller firmware, with initial value of '0' to signify unadjusted, as shown at step 201;

to transfer ink utilization data stored in EEPROM to register reg1 when receiving power signal from the printer or mounting the ink cartridge during printer power on;

to send ink utilization data to the printer from reg1 under the control of the printer upon printer power on;

to print by printer;

to store the updated ink utilization percentage written to the ink cartridge into reg1 during printer power off or removal of the ink cartridge;

to check whether the value stored in register reg1 is greater than a predetermined value y (e.g. 50) as in step 202;

to go to step 205 if the result of step 202 is yes;

to check if the value of the flag adj is 0 if the result of step 202 is no as in step 203;

to go to step 205 if the value of the flag adj as obtained in step 203 is not 0;

to subtract (x+a) from reg1 and store the result back to reg1 if the value of the flag adj in step 203 is 0 (where x % is the targeted increment in ink capacity and a % is the additional consumption due to the additional head cleaning operation), as shown at step 204;

to change the value of the flag adj to 1;

to transfer the updated ink utilization percentage as stored in register reg1 into appropriate EEPROM location during printer power off as in step 205; and end, as shown at step 206.

Figure 11A:
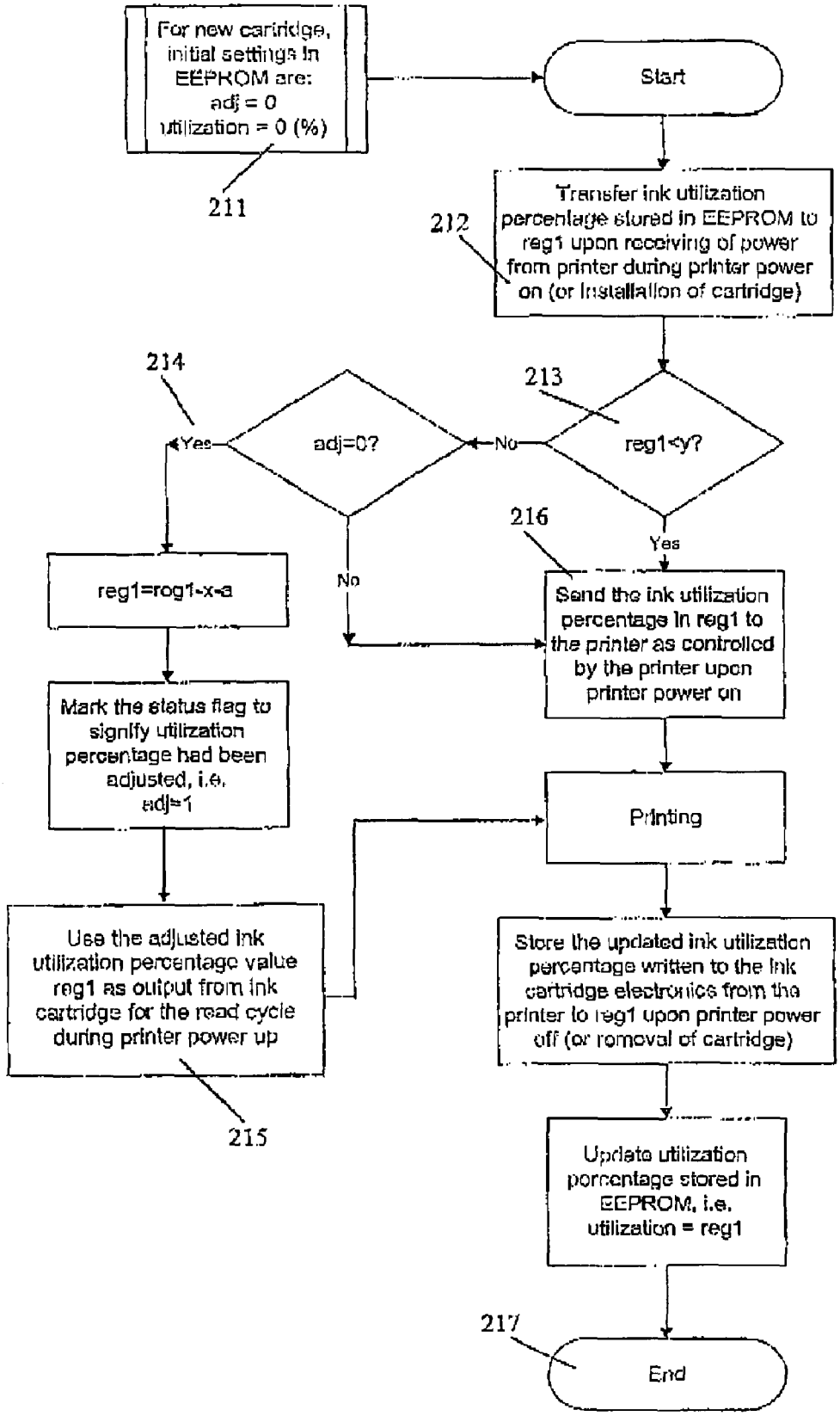
FIG. 11A is a flowchart for a supplementary design for the second embodiment of the invention.

As an alternative, as shown in FIG. 11A, the following approach may also be used:

to use a software flag (adj) stored in EEPROM in the ink cartridge electronics to signify whether the ink utilization percentage had been adjusted by the micro-controller firmware, with initial value of '0' to signify unadjusted (for new ink cartridge), as shown at step 211;

to transfer the utilization percentage as stored in EEPROM of the micro-controller to register reg1 upon printer power up or installation of cartridge to printer as shown at step 212;

to check if the value in reg1 is less than a pre-determined value y as in step 213;

to go to step 216 if the value in reg1 as in step 213 is less than y;

to check if ink value had been adjusted previously by checking if the status flag adj is 0 as in step 214;

to go to step 216 if the status flag as in step 214 is not 0;

to subtract (x+a) from register reg1 and store the result in reg1 if the flag adj in step 214 is 0, and change the flag adj to 1, and send the value in reg1 to the printer as controlled by the printer upon power on as in step 215 (where x % is the targeted increment in ink capacity and a % is the additional consumption due to the additional head cleaning operation);

to skip the next step;

to send ink utilization percentage in reg1 to printer as controlled by the printer upon printer power on as in step 216;

to print and update ink utilization percentage in printer by printer;

to store the updated ink utilization percentage written to the ink cartridge electronics from the printer to register reg1 upon printer power off or moving of cartridge holder to installation position for removal;

to update the ink utilization percentage stored in EEPROM with the value in register reg1 in the previous step; and end, as shown at step 217.

However, should the printer initiates an additional read cycle after the write cycle to update the ink utilization percentage during power off as checking and lock up if the value obtained from the read cycle differs from that written to the cartridge, this design implementation is not applicable.

To overcome the limitation of embodiment 2, in the third embodiment, a method to identify the difference between the read cycle that immediately follows a write cycle during printer power off and the read cycle during printer power on is required.

Normally, the DC power ($V_{cc}$) cycle provided by the printer to the ink cartridge electronics for the checking read cycle that follows the write cycle at printer power off is separated from the $V_{cc}$ cycle for the previous write cycle by tens of millisecond in time. As for the read cycle during printer power on, the $V_{cc}$ normally had been off in the order of seconds or more.

Figure 9:
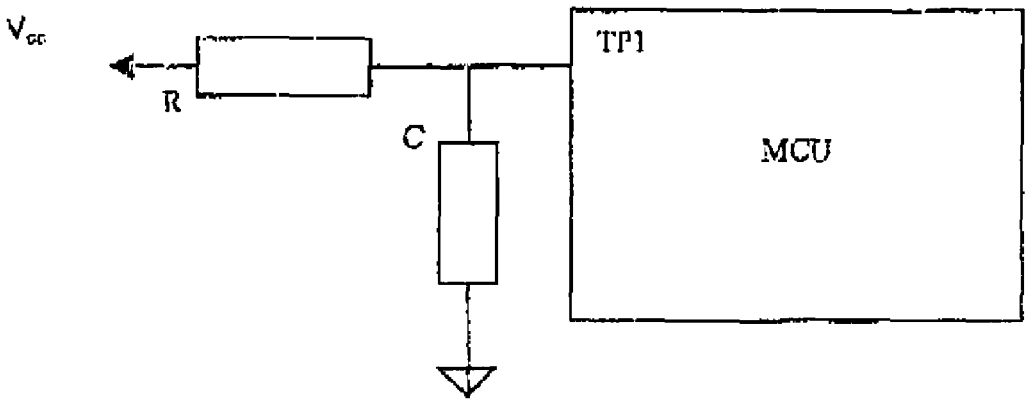
FIG. 9 is a normal read cycle & checking read cycle detection circuit.

Therefore, a R-C circuit with a time constant of approximate 1 second or other selected appropriate value connected to an input port (hereinafter called TP1) will provide the information required to distinguish the checking read cycle and the normal read cycle. This is achieved by reading the TP1 at the beginning of each $V_{cc}$ cycle. For checking read cycle, the sampled TP1 is '1'. For the normal read cycle, the sampled TP1 is '0'. The circuit is shown in FIG. 9.

Figure 12:
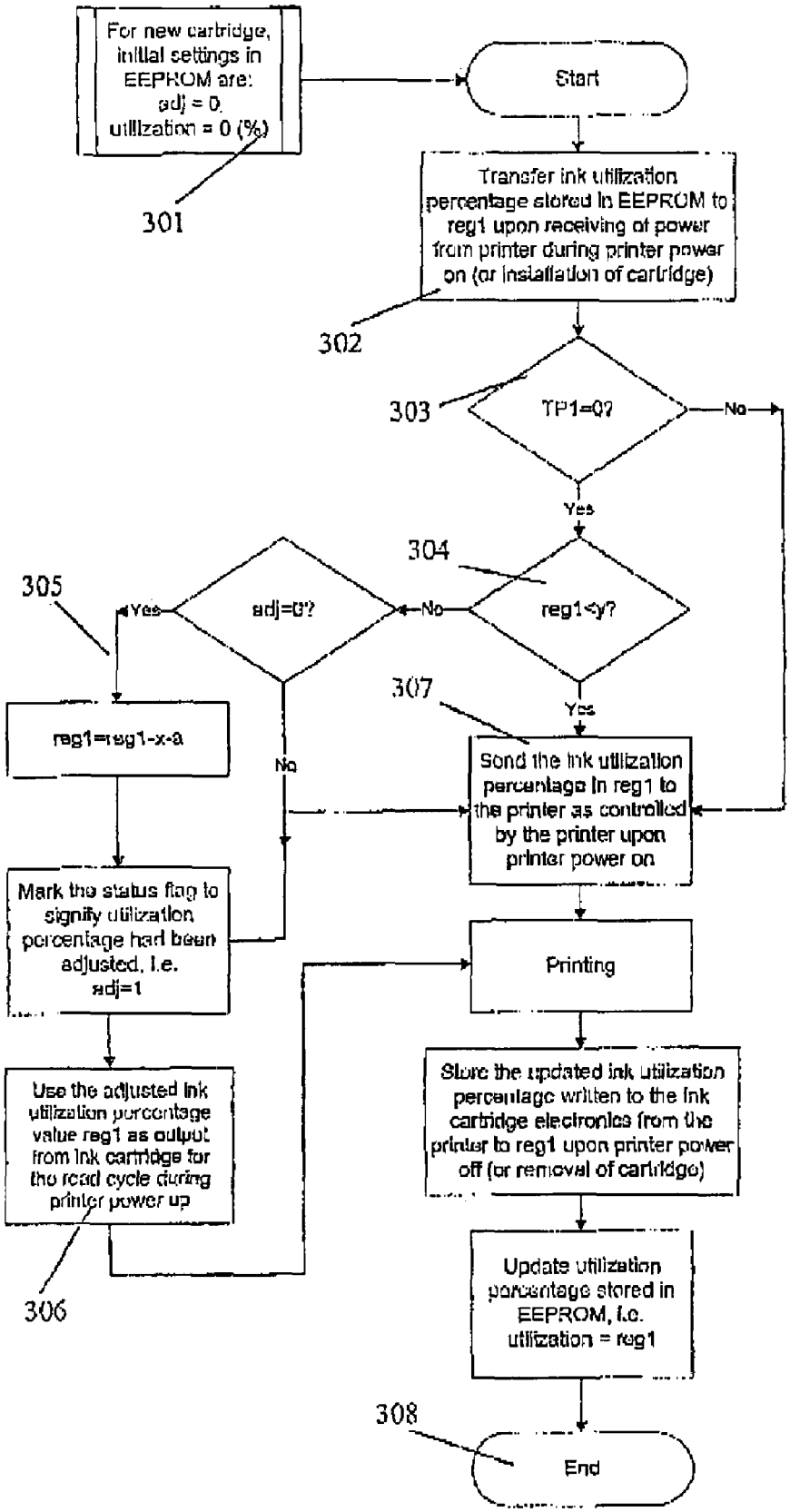
FIG. 12 is a flowchart for the third embodiment of the invention.

The following further illustrates the firmware algorithm for implementing the desired feature, as shown in FIG. 12:

to use a software flag (adj) stored in EEPROM in the ink cartridge electronics to signify whether the ink utilization percentage had been adjusted by the micro-controller firmware, with initial value of '0' to signify unadjusted, as shown at step 301;

to transfer the updated ink utilization percentage stored in EEPROM of the micro-controller to register reg1 upon printer power on or installation of cartridge as in step 302;

to check if the value of the pin TP1 is 0 as in step 303;

to go to step 307 if the TP1 is not 0 in step 303;

to check if the value in register reg1 is less than a pre-determined value y as instep 304;

to go to step 307 if the value in register reg1 is less than y in step 304;

to check if the ink utilization percentage had been modified by checking if the value of the flag adj is 0 as in step 305;

to go to step 307 if the value of the flag is not 0 as in step 305;

to subtract (x+a) from register reg1 and store the result in reg1 if the flag adj in step 305 is 0, and change the flag adj to 1, and send the value in reg1 to the printer as controlled by the printer upon power on as in step 306(where x % is the targeted increment in ink capacity and a% is the additional consumption due to the additional head cleaning operation);

to skip the next step;

to send ink utilization percentage in reg1 to printer as controlled by the printer upon printer power on as in step 307;

to print and update ink utilization percentage in printer by printer;

to store the updated ink utilization percentage written to the ink cartridge electronics from the printer to register reg1 upon printer power off or moving of cartridge holder to installation position for removal;

to update the ink utilization percentage stored in EEPROM with the value in register reg1 in the previous step; and end, as shown at step 308.

The design implementations are carried out by computer programs, which are embedded in the electronics module 2 in the intelligent ink cartridge. The electronics module 2 replaces prior passive serial EEPROM to improve the maximum of ink volume of the ink cartridge. Considering the defect of accessing ink remaining data totally controlled by the printer, the invention uses a special-purpose micro-controller to access ink remaining data in the ink cartridge to improve the ink cartridge with higher ink capacity.

While the present invention has been described with respect to what is presently considered to be the preferred embodiments, it is to be understood that the invention is not limited to the disclosed embodiments. To the contrary, the invention is intended to cover various modifications and equivalent arrangements comprised within the spirit and scope of the appended claims. The scope of the following claims is to be accorded the broadest interpretation, so as to encompass all such modifications and equivalent structures and functions.

What is claimed is:

1. An intelligent ink cartridge comprising:

at least one ink chamber for storing ink therein;

an electronics module configured to store identification information data of the ink cartridge and ink remaining data, the electronics module including a micro-controller with embedded memory storing a program executable to control access and processing of ink remaining data in the ink cartridge to improve the maximum of ink volume of the ink cartridge; and, a control circuit operatively connected with said micro-controller and defining a preselected time constant value to distinguish between a checking read cycle of said intelligent ink cartridge and a normal read cycle of said intelligent ink cartridge.

2. An intelligent ink cartridge according to claim 1, wherein said memory is an EEPROM.

3. An intelligent ink cartridge according to claim 1, wherein said micro-controller is an 8-bit CMOS RISC micro-controller.

4. An intelligent ink cartridge according to claim 1 wherein said micro-controller includes:

an arithmetic and logic unit connected with a data bus, an EEPROM memory for storing said identification information data of the ink cartridge and said ink remaining data, plural registers, an interrupt unit, a serial periphery interface unit, a timer, an analog comparator, an I/O interface; and, a program memory connected to said arithmetic and logic unit by said register for storing a program controlling reading and writing operations and calculation of ink remaining data.

5. An intelligent ink cartridge comprising:

at least one ink chamber configured to store ink therein;

an electronics module configured to store identification information data of the ink cartridge and ink remaining data, the electronics module being a micro-controller with embedded non-volatile memory storing a program executable to control access and processing of ink remaining data in the ink cartridge to improve a maximum of ink volume of the ink cartridge, said micro-controller including:

an arithmetic and logic unit connected with a data bus;

an EEPROM memory for storing said identification information data of the ink cartridge and said ink remaining data, plural registers, an interrupt unit, a serial periphery interface unit, a timer, an analog comparator, an I/O interface; and, a program memory connected to said arithmetic and logic unit by said register for storing a program controlling reading and writing operations and calculation of ink remaining data;

a R-C control circuit defining a preselected time constant value, used to distinguish between a checking read cycle of said cartridge and a normal read cycle of said cartridge, wherein, said R-C control circuit is connected to an input interface of said micro-controller.

6. The intelligent ink cartridge according to claim 5, wherein said program is adapted to execute the steps of:

transferring an ink utilization percentage stored in EEPROM to register temp1 in said micro-controller during printer power on or when the ink cartridge is installed on the associated ink jet apparatus and moved to normal position;

transferring said ink utilization percentage into said ink jet apparatus from said register temp1 when a control signal of the associated ink jet apparatus is received;

updating the ink utilization percentage at the associated ink jet apparatus during printing;

storing the updated ink utilization percentage written into the ink cartridge from the associated ink jet apparatus into the register temp2 in said micro-controller during printer power off or when the ink cartridge is moved to installation position;

executing steps in said micro-controller of:

temp3=temp2=temp1;

temp3−temp3/(1+x %), wherein, x % is the targeted increment in ink capacity of said ink cartridge;

temp1=temp1+temp3; and, storing ink utilization percentage updated to EEPROM from said register temp1 and using it as the output from cartridge to the associated ink jet apparatus for the next printer power on read cycle.

7. The intelligent ink cartridge according to claim 6, wherein said program is adapted to further execute a check step for checking whether updated ink utilization percentage is larger than predetermined value y, and adjusting the ink utilization percentage if no previous adjustments had been performed wherein x % is the targeted increment in ink capacity and a % is the additional consumption due to an additional head cleaning operation, so as to check whether ink utilization has been adjusted when ink utilization percentage is higher than (x+a)% and the ink utilization is updated, wherein, adj=0 means ink utilization has been not adjusted and adj=1 means ink utilization has been done.

8. The intelligent ink cartridge according to claim 7, wherein the check step for checking whether said micro-controller has adjusted ink utilization percentage of a new ink cartridge includes:

setting an initial status flag into EEPROM of a new ink cartridge;

reading and judging said status flag; and, subtracting (x+a) from the updated ink utilization percentage before storage to EEPROM should the status flag has been not adjusted and updated ink utilization percentage be higher than (x+a)%, and change the flag to signify ink utilization percentage had been adjusted.

9. The intelligent ink cartridge according to claim 7, wherein said program is adapted to further execute an additional check step for distinguishing a first read cycle immediately following a write cycle during printer power off from a second read cycle performed during printer power on.

10. The ink cartridge apparatus according to claim 5, wherein said program is executable by said micro-controller for manipulating said ink remaining data for increasing said utilization of ink from the ink cartridge apparatus by:

transferring ink utilization percentage data stored in a register temp1 in said micro-controller i) during a power on cycle of said associated printing device and ii) when the ink cartridge apparatus is installed on the associated printing device and moved to a normal position;

transferring the ink utilization percentage data into the associated printing device from register temp1 in response to a control signal received from the associated printing device is received;

updating the ink utilization percentage data after a printing operation;

storing the ink utilization percentage data written into the ink cartridge apparatus from the associated printing device into a register temp2 in said micro-controller during a power off of said associated printing device or when said ink cartridge apparatus is moved to an installation position relative to said associated printing device;

subtracting the previously stored ink utilization percentage data in register temp1 from the updated ink utilization percentage data in register temp2 and storing the result of said subtracting into a register temp3;

dividing a value temp3=temp2−temp1 obtained in the subtracting step by a divisor (1+x %) to generate a quotient value and storing the quotient value in register temp3;

adding the quotient value in register temp3 obtained in said dividing step to said previously stored ink utilization percentage data in register temp1 as temp1=temp3+temp1;

storing the value in register temp1 in a memory of said micro-controller; and, using the value temp1 stored in said register as an output from said ink cartridge apparatus to said associated printing device during a subsequent power on read cycle of said associated printing device.

11. The ink cartridge apparatus according to claim 5, wherein said program is executable by said microcontroller for manipulating said ink remaining data for increasing said utilization of ink from the ink cartridge apparatus by:

using a software flag (adj) stored in a memory of said micro-controller on said ink cartridge apparatus to signify whether said ink utilization data had been adjusted by the micro-controller using an initial logical value of "0" to signify an unadjusted state;

transferring said ink utilization data stored in said memory to a register reg1 when receiving a power signal from said associated printing device or when mounting said ink cartridge apparatus during a power on cycle of said associated printing device;

sending said ink utilization data to said associated printing device from reg1 under control of said associated printing device upon a power on cycle of said associated printing device;

permitting a printing operation by said associated printing device;

storing said updated ink utilization data written to said ink cartridge apparatus into register reg1 during a power off cycle of said associated printing device or during a removal of the ink cartridge apparatus from the associated printing device;

transferring, when the value stored in register reg1 is less than a predetermined value y and the logical value of the flag adj is "0", the updated ink utilization percentage data as stored in register reg1 into a predetermined memory location in said micro-controller during a power off cycle of said associated printing device; and, subtracting, when the logical value stored in register reg1 is less than said predetermined value y and said logical value of the flag adj is "0", (x+a) from register reg1 and storing the result back to register reg1, where x % is a targeted increment in ink capacity and a% is an additional consumption due to additional head cleaning operations performed by said associated printing device.

12. The ink cartridge apparatus according to claim 5, wherein said program is executable by said micro-controller for manipulating said ink remaining data for increasing said utilization of ink from the ink cartridge apparatus by:

using a software flag (adj) stored in a memory location in said micro-controller to signify whether said ink utilization data had been adjusted by the micro-controller with an initial logical value of "0" to signify an unadjusted state;

transferring the updated ink utilization data stored in said memory location of said micro-controller to a register reg1 upon a power on cycle of said associated printing device or upon an installation of said ink cartridge onto said associated printing device;

sending said ink utilization percentage data in register reg1 to said associated printing device upon a power on cycle of said printing device when a one of: i) an external signal TP1 is received by said micro-controller indicating a normal read cycle logic level TP1=0, ii) when a value stored in register reg1 is less than a predetermined value y, and iii) when said ink utilization percentage data had been modified as determined based on the value of the software flag adj being a logic level 1 value;

subtracting (x+a) from register reg1 and storing the result in register reg1 when i) said software flag adj has a logic value of "0", ii) the value stored in register reg1 is greater than said predetermined value y, and iii) the external signal TP1 received indicates a checking read cycle logic level TP1=1 and changing said software flag adj to a logic level of "1" and sending the value in reg1 to the associated printing device upon a power on cycle where x % is a targeted increment in ink capacity and a % is an additional consumption due to an additional head cleaning operation in said associated printing device;

permitting a printing operation in said associated printing device;

storing the updating ink utilization percentage data written to said micro-controller from said associated printing device to register reg1 upon a power off cycle of said associated printing device or upon a moving of said ink cartridge apparatus to an installation position for removal relative to said associated printing device; and, updating the ink utilization percentage data stored in a memory of said micro-controller with the value stored in register reg1.

13. The intelligent ink cartridge according to claim 5, wherein said program improves said maximum of ink volume in said cartridge by manipulating said ink remaining data to increase a utilization of ink consumed from the ink cartridge.

14. An ink cartridge comprising:

at least one ink chamber configured to store ink therein;

an electronics module configured to store identification information data of the ink cartridge and ink remaining data, and;

a control circuit defining a preselected time constant value to distinguish between a checking read cycle of said cartridge and a normal read cycle of said cartridge.

15. The ink cartridge according to claim 14, wherein:

the electronics module includes a micro-controller with embedded memory storing a program executable to control access and processing of said ink remaining data in the ink cartridge to improve an amount of ink volume consumed from the ink cartridge.

16. The ink cartridge according to claim 15, wherein:

said R-C control circuit is connected to an input interface of said micro-controller.

17. An ink cartridge according to claim 15, wherein said non-volatile memory is an EEPROM.

18. An ink cartridge according to claim 15, wherein said micro-controller is an 8-bit CMOS RISC micro-controller.

19. An ink cartridge according to claim 15, wherein said micro-controller includes:

an ALU (arithmetic and logic unit) connected with a data bus;

an EEPROM memory for storing said identification information data of the ink cartridge and said ink remaining data;

plural registers;

an interrupt unit;

a serial periphery interface unit;

a timer;

an analog comparator;

an I/O interface, and, a program memory portion of said embedded memory connected to said ALU by at least one of said plurality of registers for storing a program controlling reading and writing operations and a calculation of ink remaining data.

20. An ink cartridge according to claim 15, wherein said program is adapted to execute the steps of:

transferring an ink utilization percentage stored in EEPROM to register temp1 in said micro-controller during printer power on or when the ink cartridge is installed on the associated ink jet apparatus and moved to normal position;

transferring said ink utilization percentage into said ink jet apparatus from said register temp1 when a control signal of the associated ink jet apparatus is received;

updating the ink utilization percentage at the associated ink jet apparatus during printing;

storing the updated ink utilization percentage written into the ink cartridge from the associated ink jet apparatus into the register temp2 in said micro-controller during printer power off or when the ink cartridge is moved to installation position;

executing steps in said micro-controller of:

temp3=temp2=temp1;

temp3−temp3/(1+x %), wherein, x % is the targeted increment in ink capacity of said ink cartridge;

temp1=temp1+temp3; and, storing ink utilization percentage updated to EEPROM from said register temp1 and using it as the output from cartridge to the associated ink jet apparatus for the next printer power on read cycle.

21. An ink cartridge according to claim 20, wherein said program is adapted to further execute a check step for checking whether updated ink utilization percentage is larger than predetermined value y, and adjusting the ink utilization percentage if no previous adjustments had been performed wherein x % is the targeted increment in ink capacity and a % is the additional consumption due to an additional head cleaning operation, so as to check whether ink utilization has been adjusted when ink utilization percentage is higher than (x+a)% and the ink utilization is updated, wherein, adj=0 means ink utilization has been not adjusted and adj=1 means ink utilization has been done.

22. An ink cartridge according to claim 21, wherein the check step for checking whether said micro-controller has adjusted ink utilization percentage of a new ink cartridge includes:

setting an initial status flag into EEPROM of a new ink cartridge;

reading and judging said status flag;

subtracting (x+a) from the updated ink utilization percentage before storage to EEPROM should the status flag has been not adjusted and updated ink utilization percentage be higher than (x+a)%, and change the flag to signify ink utilization percentage had been adjusted.

23. An ink cartridge according to claim 21, wherein said program is adapted to further execute an additional check step for distinguishing a first read cycle immediately following a write cycle during printer power off from a second read cycle performed during printer power on.

24. The ink cartridge apparatus according to claim 15, wherein said program is executable by said micro-controller for manipulating said ink remaining data for increasing said utilization of ink from the ink cartridge apparatus by:

transferring ink utilization percentage data stored in a register temp1 in said micro-controller i) during a power on cycle of said associated printing device and ii) when the ink cartridge apparatus is installed on the associated printing device and moved to a normal position;

transferring the ink utilization percentage data into the associated printing device from register temp1 in response to a control signal received from the associated printing device is received;

updating the ink utilization percentage data after a printing operation;

storing the ink utilization percentage data written into the ink cartridge apparatus from the associated printing device into a register temp2 in said micro-controller during a power off of said associated printing device or when said ink cartridge apparatus is moved to an installation position relative to said associated printing device;

subtracting the previously stored ink utilization percentage data in register temp1 from the updated ink utilization percentage data in register temp2 and storing the result of said subtracting into a register temp3;

dividing a value temp3=temp2−temp1 obtained in the subtracting step by a divisor (1+x %) to generate a quotient value and storing the quotient value in register temp3;

adding the quotient value in register temp3 obtained in said dividing step to said previously stored ink utilization percentage data in register temp1 as temp1=temp3+temp1;

storing the value in register temp1 in a memory of said micro-controller; and, using the value temp1 stored in said register as an output from said ink cartridge apparatus to said associated printing device during a subsequent power on read cycle of said associated printing device.

25. The ink cartridge apparatus according to claim 24, wherein said program is executable by said microcontroller for manipulating said ink remaining data for increasing said utilization of ink from the ink cartridge apparatus by:

using a software flag (adj) stored in a memory of said micro-controller on said ink cartridge apparatus to signify whether said ink utilization data had been adjusted by the micro-controller using an initial logical value of "0" to signify an unadjusted state;

transferring said ink utilization data stored in said memory to a register reg1 when receiving a power signal from said associated printing device or when mounting said ink cartridge apparatus during a power on cycle of said associated printing device;

sending said ink utilization data to said associated printing device from reg1 under control of said associated printing device upon a power on cycle of said associated printing device;

permitting a printing operation by said associated printing device;

storing said updated ink utilization data written to said ink cartridge apparatus into register reg1 during a power off cycle of said associated printing device or during a removal of the ink cartridge apparatus from the associated printing device;

transferring, when the value stored in register reg1 is less than a predetermined value y and the logical value of the flag adj is "0", the updated ink utilization percentage data as stored in register reg1 into a predetermined memory location in said micro-controller during a power off cycle of said associated printing device; and, subtracting, when the logical value stored in register reg1 is less than said predetermined value y and said logical value of the flag adj is "0", (x+a) from register reg1 and storing the result back to register reg1, where x % is a targeted increment in ink capacity and a % is an additional consumption due to additional head cleaning operations performed by said associated printing device.

26. The ink cartridge apparatus according to claim 15, wherein said computer program is executable by said micro-controller for manipulating said ink remaining data for increasing said utilization of ink from the ink cartridge apparatus by:

using a software flag (adj) stored in a memory location in said micro-controller to signify whether said ink utilization data had been adjusted by the micro-controller with an initial logical value of "0" to signify an unadjusted state;

transferring the updated ink utilization data stored in said memory location of said micro-controller to a register reg1 upon a power on cycle of said associated printing device or upon an installation of said ink cartridge onto said associated printing device;

sending said ink utilization percentage data in register reg1 to said associated printing device upon a power on cycle of said printing device when a one of: i) an external signal TP1 is received by said micro-controller indicating a normal read cycle logic level TP1=0, ii) when a value stored in register reg1 is less than a predetermined value y, and iii) when said ink utilization percentage data had been modified as determined based on the value of the software flag adj being a logic level 1 value;

subtracting (x+a) from register reg1 and storing the result in register reg1 when i) said software flag adj has a logic value of "0", ii) the value stored in register reg1 is greater than said predetermined value y, and iii) the external signal TP1 received indicates a checking read cycle logic level TP1=1 and changing said software flag adj to a logic level of "1" and sending the value in reg1 to the associated printing device upon a power on cycle where x % is a targeted increment in ink capacity and a % is an additional consumption due to an additional head cleaning operation in said associated printing device;

permitting a printing operation in said associated printing device;

storing the updating ink utilization percentage data written to said micro-controller from said associated printing device to register reg1 upon a power off cycle of said associated printing device or upon a moving of said ink cartridge apparatus to an installation position for removal relative to said associated printing device; and, updating the ink utilization percentage data stored in a memory of said micro-controller with the value stored in register reg1.

27. The ink cartridge according to claim 15, wherein said program stored in said memory of the micro-controller is configured to manipulate said ink remaining data for increasing a utilization of ink from the ink cartridge.

* * * * *